US008537189B2

(12) United States Patent
Shiraishi

(10) Patent No.: US 8,537,189 B2
(45) Date of Patent: Sep. 17, 2013

(54) THERMAL PRINTER AND DRIVING METHOD THEREOF

(75) Inventor: Norihisa Shiraishi, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 28 days.

(21) Appl. No.: 13/409,414

(22) Filed: Mar. 1, 2012

(65) Prior Publication Data

US 2012/0224016 A1 Sep. 6, 2012

(30) Foreign Application Priority Data

Mar. 3, 2011 (JP) ..... 2011-46911

(51) Int. Cl.
*B41J 11/18* (2006.01)

(52) U.S. Cl.
USPC ..... 347/220

(58) Field of Classification Search
USPC ..... 347/218, 220
See application file for complete search history.

(56) References Cited

U.S. PATENT DOCUMENTS

| | | | | |
|---|---|---|---|---|
| 2003/0112318 | A1* | 6/2003 | Long et al. | 347/171 |
| 2003/0114301 | A1* | 6/2003 | Beckerdite et al. | 503/200 |
| 2006/0289633 | A1* | 12/2006 | Moreland et al. | 235/381 |
| 2007/0120942 | A1* | 5/2007 | Van Demark et al. | 347/221 |
| 2007/0120943 | A1* | 5/2007 | Van Demark et al. | 347/221 |
| 2007/0134039 | A1* | 6/2007 | Van Demark et al. | 400/61 |
| 2007/0210572 | A1* | 9/2007 | Halbrook et al. | 283/62 |
| 2008/0003039 | A1* | 1/2008 | Sekino et al. | 400/188 |
| 2008/0003041 | A1* | 1/2008 | Sekino et al. | 400/188 |
| 2010/0231681 | A1* | 9/2010 | Nihashi et al. | 347/218 |
| 2011/0058879 | A1* | 3/2011 | Shiraishi | 400/582 |
| 2011/0203716 | A1* | 8/2011 | Shiraishi | 156/64 |
| 2011/0293347 | A1* | 12/2011 | Sekino et al. | 400/582 |
| 2012/0218368 | A1* | 8/2012 | Eoka | 347/198 |

FOREIGN PATENT DOCUMENTS

| | | |
|---|---|---|
| EP | 0947340 | * 10/1999 |
| JP | 2002-219832 | 8/2002 |
| JP | 2006-341549 | 12/2006 |

* cited by examiner

*Primary Examiner* — Huan Tran
(74) *Attorney, Agent, or Firm* — Turocy & Watson, LLP

(57) ABSTRACT

Provided is a thermal printer for printing information on thermal paper having a thermosensitive layer formed on both sides thereof, including first and second thermal heads, the first thermal head printing on one side of the thermal paper and the second thermal head printing on the other side of the thermal paper; a first platen installed at a position opposite the first thermal head, and configured to move for closing so as to approach the first thermal head and move for opening so as to be distanced therefrom; a second platen installed at a position opposite the second thermal head, and configured to move for closing so as to approach the second thermal head and move for opening so as to be distanced therefrom; and a control unit configured to control the first and second platens.

10 Claims, 8 Drawing Sheets

THERMAL PRINTER AND DRIVING METHOD THEREOF

CROSS-REFERENCE TO RELATED APPLICATION

This application is based upon and claims the benefit of priority from Japanese Patent Application No. 2011-046911, filed on Mar. 3, 2011, the entire contents of which are incorporated herein by reference.

FIELD

Embodiments described herein relate generally to a thermal printer using thermal paper with a thermosensitive layer formed on both sides thereof, and a driving method thereof.

BACKGROUND

A thermal printer, which performs a paper feeding operation for printing by inserting thermosensitive layer-formed thermal paper between a thermal head and a platen, has been proposed.

In such a thermal printer, the platen is configured to apply constant pressure to the thermal head no matter whether or not printing is performed. This pressure adversely affects the life span of the thermal head.

DETAILED DESCRIPTION

According to one embodiment, provided is a thermal printer for printing information on thermal paper having a thermosensitive layer formed on both sides thereof, while feeding the thermal paper. The thermal printer includes first and second thermal heads installed at positions spaced apart from each other along a feeding direction of the thermal paper, the first thermal head printing on one side of the thermal paper and the second thermal head printing on the other side of the thermal paper. The thermal printer also includes a first platen installed at a position opposite the first thermal head with a feeding path of the thermal paper interposed therebetween, and configured to move to a closed position (move for closing) so as to approach the first thermal head and move to an open position (move for opening) so as to be distanced from the first thermal head, the thermal paper being interposed between the first platen and the first thermal head according to the closing movement of the first platen. A second platen is installed at a position opposite the second thermal head with the feeding path of the thermal paper interposed therebetween, and configured to move for closing so as to approach the second thermal head and move for opening so as to be distanced from the second thermal head, the thermal paper being interposed between the second platen and the second thermal head according to the closing movement of the second platen. The thermal printer further includes a control unit configured to initiate feeding of the thermal paper in a state in which the first and second platens have moved for opening, execute printing in a state in which the first and second platens have moved for closing when a front end of the thermal paper reaches the first and second thermal heads, respectively, and control the first and second platens to move for opening when the front end of the thermal paper passes through the first and second thermal heads, respectively, while returning the thermal paper, which has been cut after being printed, in the opposite direction of the feeding direction after the cutting operation.

Figure 1:
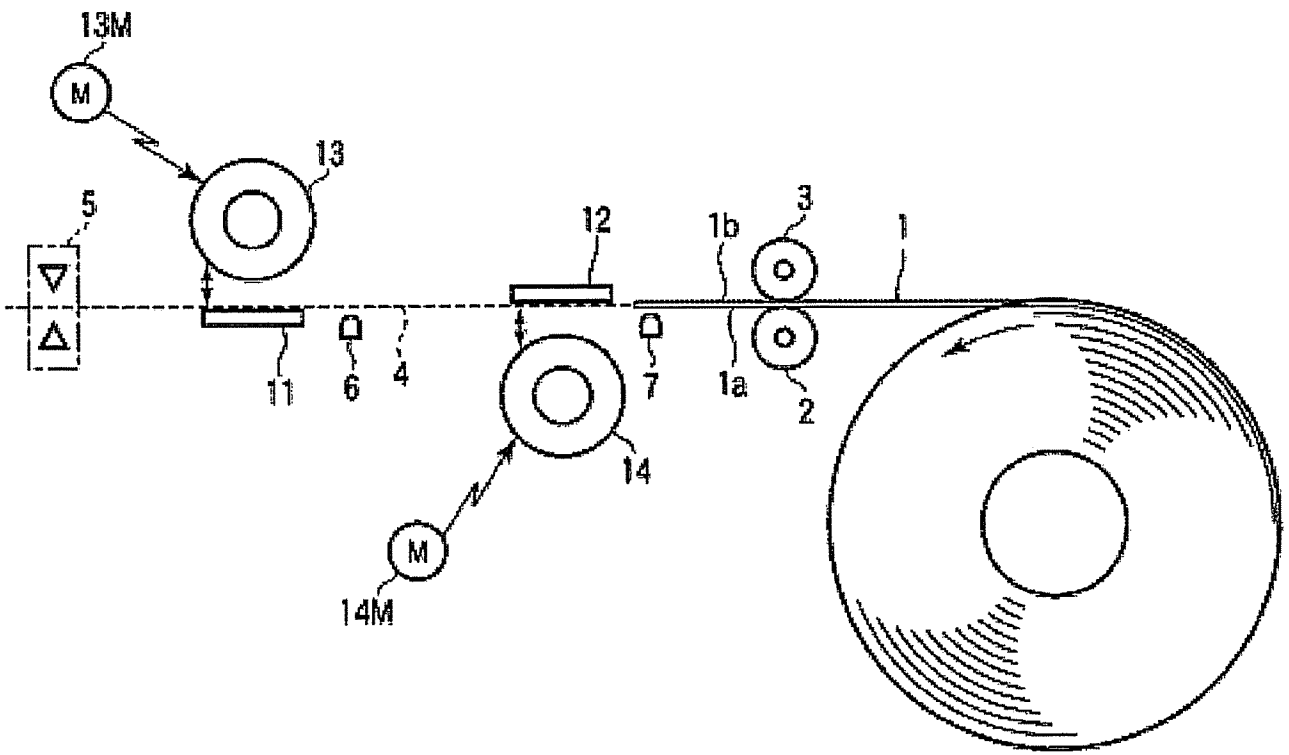
FIG. 1 is a view showing a configuration of a major portion of an embodiment.

Embodiments will now be described in detail with reference to the drawings. First, the configuration of a major portion of an embodiment is illustrated in FIG. 1.

A thermal paper 1, which has a thermosensitive layer on both a front surface 1*a* and a rear surface 1*b*, is wound in a rolling manner in a state in which the front surface 1*a* is at an inner side. The thermosensitive layer is made of a material which forms the color of, for example, black or red when heated at a predetermined temperature or higher. A front end of the thermal paper 1 is fed to the feeding path 4 by feeding rollers 2 and 3, and transferred along the feeding path 4.

A first thermal head 11, facing the front surface 1*a* of the thermal paper 1, and a second thermal head 12, facing the rear surface 1*b* of the thermal paper 1, are disposed along the feeding direction of the thermal paper 1. The first and second thermal heads 11 and 12 are configured to extend in a direction perpendicular to the feeding direction of the thermal paper 1, namely, in a widthwise direction of the thermal paper 1, and installed to be spaced apart from each other along the feeding direction of the thermal paper 1. The first thermal head 11 is disposed at the downstream direction with respect to the second thermal head 12 in the feeding direction of the thermal paper 1.

A first platen roller 13 is disposed at a position opposite the first thermal head 11 with the feeding path 4 interposed therebetween, and a second platen roller 14 is disposed at a position opposite the second thermal head 12 with the feeding path 4 interposed therebetween.

As indicated by an arrow, the first platen roller 13 can move for closing so as to approach the first thermal head 11 and move for opening so as to be distanced from the first thermal head 11. According to the closing movement of the first platen roller 13, the thermal paper 1 is interposed between the first platen roller 13 and the first thermal head 11 and the front surface 1*a* of the thermal paper 1 is effectively brought into contact with the first thermal head 11. A motor 13M is installed as a power source for the closing and opening movement of the first platen roller 13.

As indicated by an arrow, the second platen roller 14 can also move for closing so as to approach the second thermal head 12 and move for opening so as to be distanced from the second thermal head 12. According to the closing movement of the second platen roller 14, the thermal paper 1 is interposed between the second platen roller 14 and the second thermal head 12 and the rear surface 1*b* of the thermal paper 1 is effectively brought into contact with the second thermal head 12. A motor 14M is installed as a power source for the closing and opening movement of the second platen roller 14.

The first and second platen rollers 13 and 14 have, as closing movement positions, a first closing movement position at which the distance between the respective thermal head and the corresponding platen roller is Dx and a second closing movement position at which the distance between the respective thermal head and the corresponding platen roller is Dy (>Dx).

In the feeding direction, a cutter 5 for cutting the thermal paper 1 is disposed at a downstream direction of the first thermal head 11 and the first platen roller 13, and a paper sensor 6 is disposed at an upstream direction of the first thermal head 11. The paper sensor 6 includes a light emitting element for emitting light towards the feeding path 4 and a light receiving element for receiving reflected light from the thermal paper 1 on the feeding path 4. The paper sensor 6 detects whether or not the thermal paper 1 is positioned in front of the first thermal head 11 depending on whether or not the light receiving element receives light. A paper sensor 7 is disposed at an upstream direction of the second thermal head 12 in the feeding direction. The paper sensor 7 includes a light emitting element for emitting light toward the feeding path 4 and a light receiving element for receiving reflected light from the thermal paper 1 on the feeding path 4. The paper sensor 7 detects whether or not the thermal paper 1 is positioned in front of the second thermal head 14 depending on whether or not the light receiving element receives light.

Figure 2:
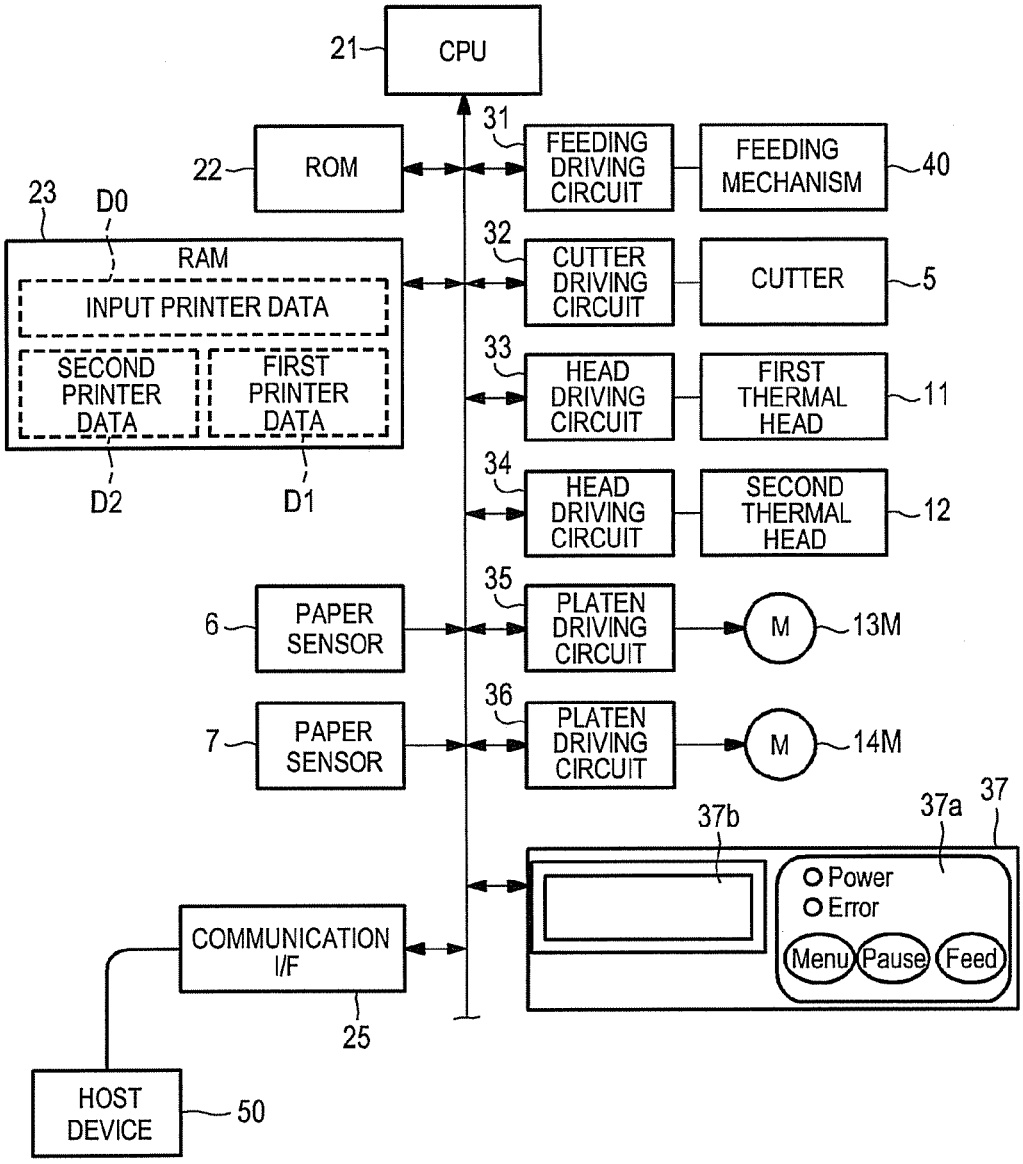
FIG. 2 is a block diagram of a control circuit of the embodiment.

FIG. 2 illustrates a block diagram of a control circuit according to the present embodiment.

A microcomputer including a CPU 21, a ROM 22 for storing a control program, a RAM 23 for storing data, and the like operates as a nucleus for controlling the thermal printer. The paper sensors 6 and 7, a communication interface 25, a feeding driving circuit 31, a cutter driving circuit 32, head driving circuits 33 and 34, platen driving circuits 35 and 36, and a control panel 37 are connected to the CPU 21 of the microcomputer. The control panel 37 includes a manipulation unit 37*a* including a plurality of manipulation buttons and display lamps, and a liquid crystal display unit 37*b*.

An external host device 50 is connected to the communication interface 25. The feeding driving circuit 31 drives a feeding mechanism 40 including the feeding rollers 2 and 3 and the feeding path 4. The cutter driving circuit 32 drives the cutter 5. The head driving circuits 33 and 34 drive the first and second thermal heads 11 and 12, respectively. The platen driving circuits 35 and 36 drive the platen roller driving motors 13M and 14M, respectively.

Further, the CPU 21 has the following units (1) to (4) as major functions based on a control program within the ROM 22.

(1) A data sort control unit is provided, which sorts printer data D0 supplied from the external host device 50 into first printer data D1 with respect to the front surface 1*a* of the thermal paper 1 and second printer data D2 with respect to the rear surface 1*b* of the thermal paper 1. The printer data D0, the first printer data D1, and the second printer data D2 are all stored in the RAM 23.

(2) A first control unit is provided, which initiates feeding of the thermal paper 1 in a state in which the first and second platen rollers 13 and 14 have moved for opening in performing printing by at least one of the first and second thermal heads 11 and 13; executes printing while controlling the first and second platen rollers 13 and 14 to move for closing when a front end of the thermal paper 1 reaches the first and second thermal heads 11 and 12, respectively; drives the cutter 5 when the end of a print position of the printing-completed thermal paper 1 passes through the position of the cutter 5 in order to cut the thermal paper 1; and controls the first and second platen rollers 13 and 14 to move for opening when the front end of the thermal paper 11 passes through the first and second thermal heads 11 and 12, respectively, while returning the thermal paper 1 in the opposite direction of the feeding direction after the cutting operation.

Figure 3:
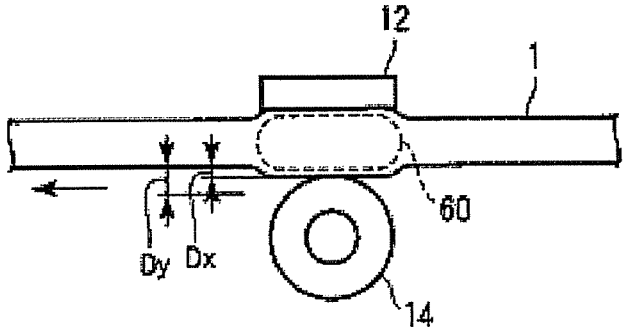
FIG. 3 is a view showing a major portion of an IC chip-containing type thermal paper in relation to the embodiment.

(3) A second control unit is provided, which sets the first closing movement position (the distance Dx) as a normal mode of the closing movement position of the first and second platen rollers 13 and 14 when the thermal paper 1 does not include an IC chip, and sets the second closing movement position (the distance Dy) as the closing movement position of the first and second platen rollers 13 and 14 when the thermal paper 1 contains an IC chip 60 illustrated in FIG. 3. Whether or not the setting for the thermal paper 1 to include the IC chip 60 is set may be determined by manipulating the control panel 37.

(4) A third control unit is provided, which controls the first and second platen rollers 13 and 14 to move for opening according to a certain manipulation of the control panel 37 and to be maintained in that position, which is referred to as opening movement position. This controlling is performed when the thermal paper 1 is jammed at the feeding path 4, or in the case of repair or maintenance work performed by a service person.

Figure 4A:
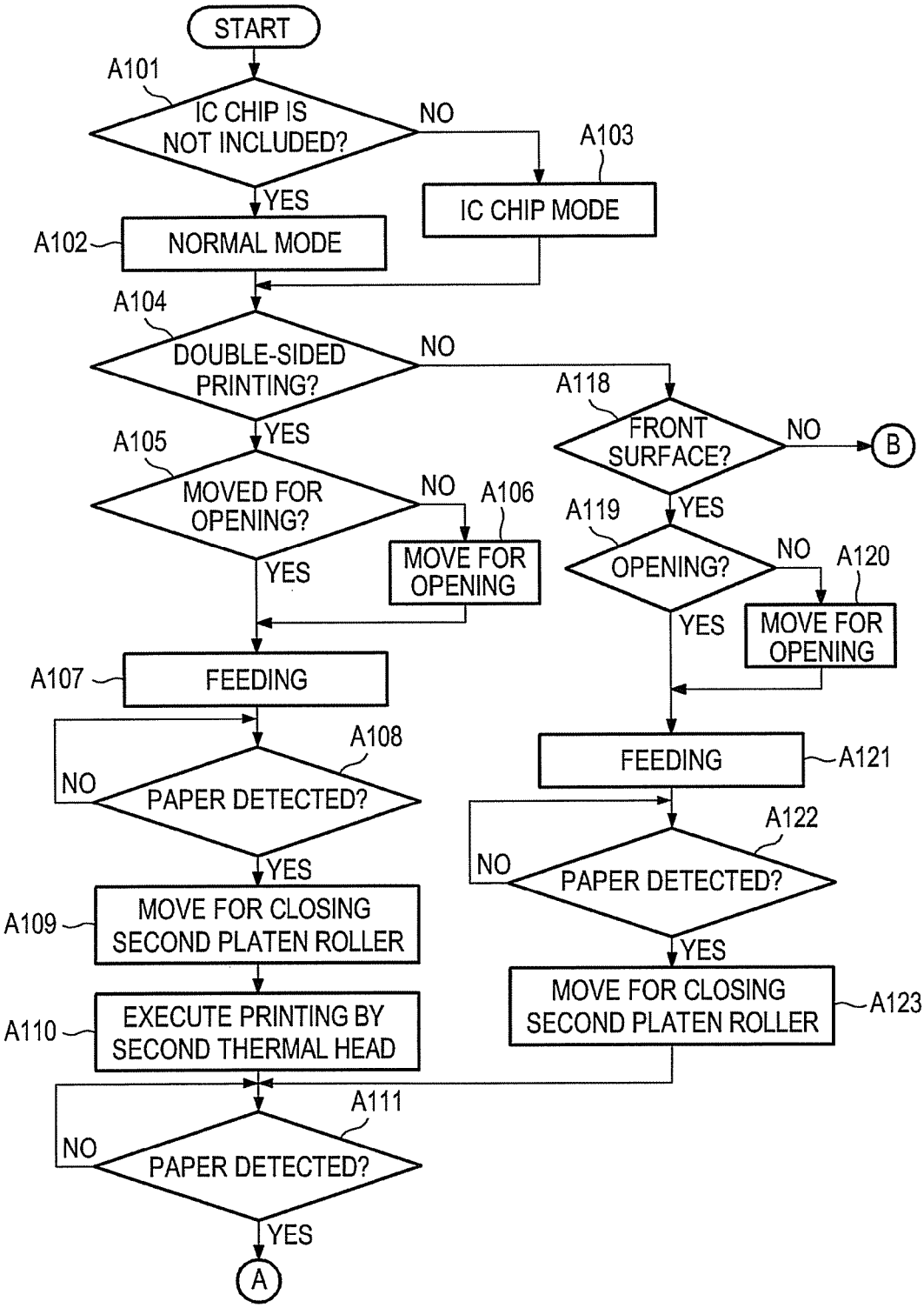
FIGS. 4A to 4C are flowcharts for explaining an operation of the embodiment.
Figure 4B:
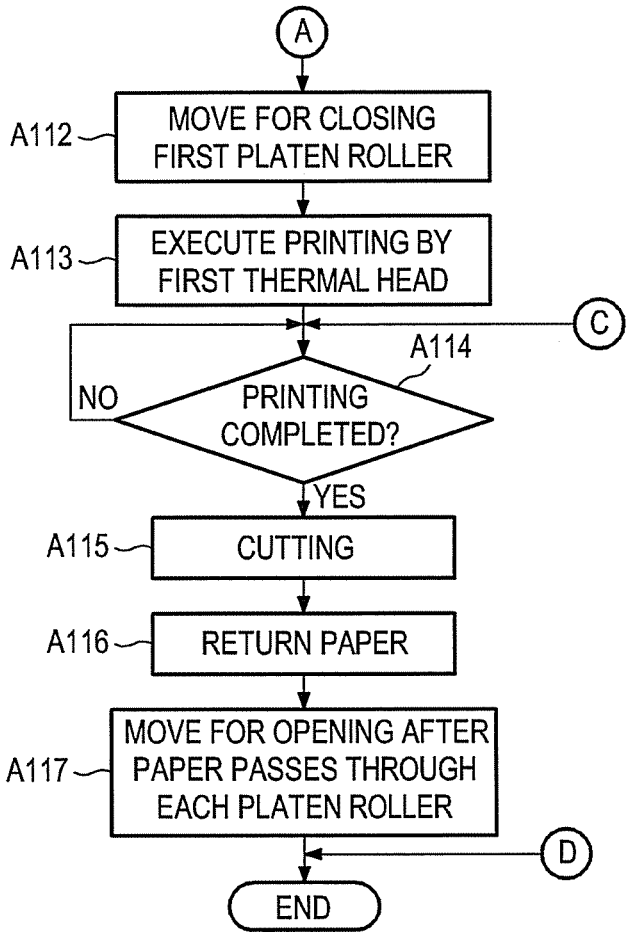
Figure 4C:
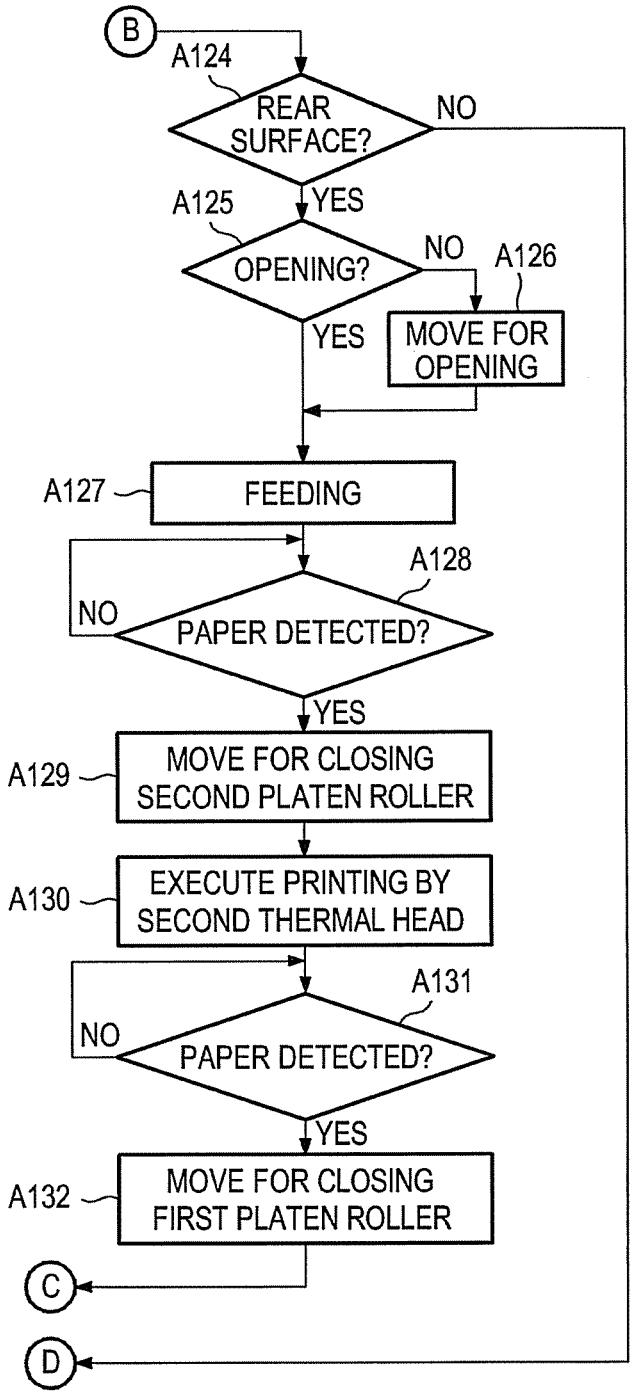
Figure 6:
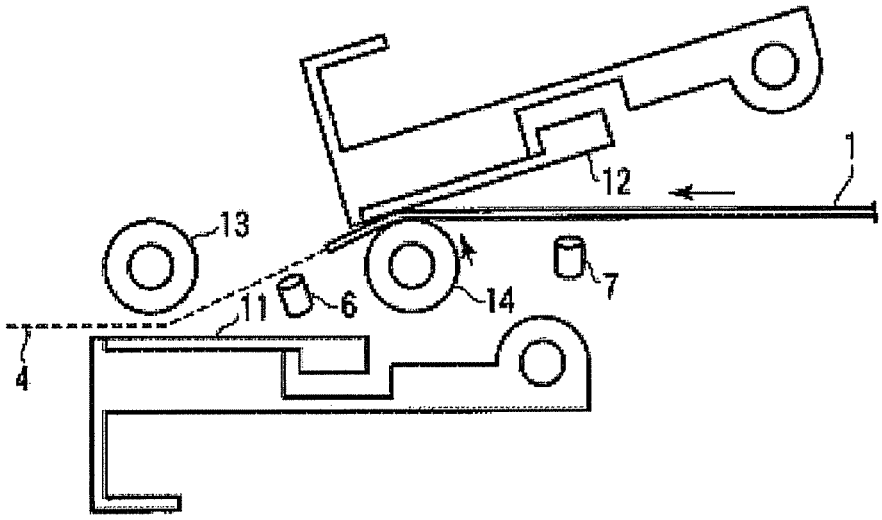
FIG. 6 is a view showing a state in which the thermal paper reaches a second thermal head in the embodiment.
Figure 7:
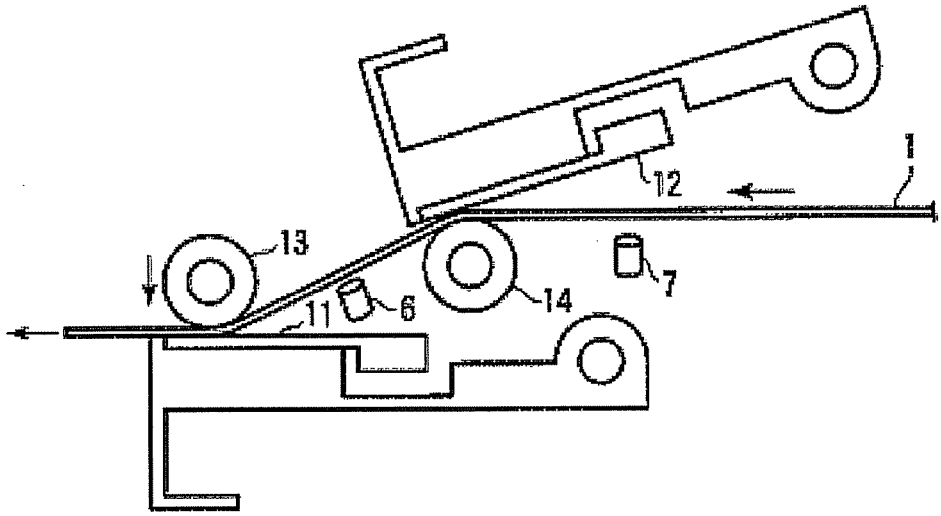
FIG. 7 is a view showing a state in which the thermal paper has reached a first thermal head through the second thermal head in the embodiment.

Now, the operation of a thermal printer of one embodiment will be described with reference to FIGS. 4A to 7. FIGS. 4A to 4C show processing of the CPU 21, and FIGS. 5 to 7 show a change in the position of the thermal paper 1 and a change in the state of the first and second platen rollers 13 and 14.

Figure 5:
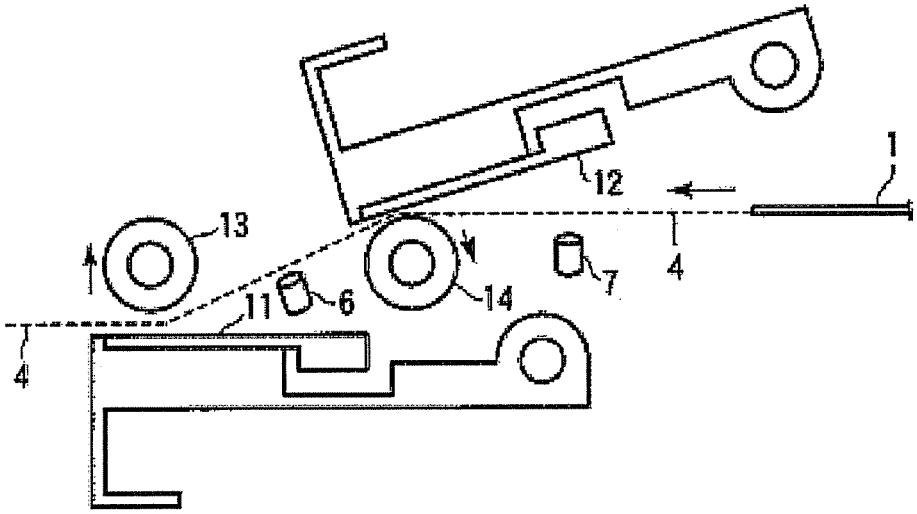
FIG. 5 is a view showing a state in which the thermal paper is at a home position in the embodiment.

While printing is not being performed, as shown in FIG. 5, the platen rollers 13 and 14 move for opening so as to be separated from the first and second thermal heads 11 and 12, respectively, and the front end of the thermal paper 1 is in standby at a feeding standby position or a home position in an upstream direction of the paper sensor 7.

When the thermal paper 1 not including an IC chip is set by the control panel 37 (YES in action A101), the first closing movement position of the distance Dx is set as a normal mode regarding the closing movement position of the first and second platen rollers 13 and 14 (action A102). However, when the use of the thermal paper 1 including an IC chip is set by the control panel 37 (NO in action A101), the second closing movement position of the distance Dy is set as an IC chip mode regarding the closing movement position of the first and second platen rollers 13 and 14 (action A103). The distance Dy of the IC chip mode is greater than the distance Dx of the normal mode by the thickness of the IC chip 60.

When double-sided printing is performed by the first and second thermal heads 11 and 12 (YES in action A104), it is determined whether both the first and second platen rollers 13 and 14 have moved for opening (action A105). If the first and second platen rollers 13 and 14 have not moved for opening (NO in action A105), they are moved for opening (action A106). In this state, feeding of the thermal paper 1 is initiated (action A107).

When the front end of the fed thermal paper 1 reaches a position in an upstream direction of the second thermal head 12, the front end of the thermal paper 1 is detected by the paper sensor 7 (YES in action A108). Based on this detection, as shown in FIG. 6, the second platen roller 14 moves for closing (action A109), and the thermal paper 1 is pressed to the second thermal head 12. In this state, printing is executed by the second thermal head 12 (action A110).

When the front end of the thermal paper 1, which has passed through the position of the second thermal head 12, reaches a position in an upstream direction of the first thermal head 11, the front end of the thermal paper 1 is detected by the paper sensor 6 (YES in action A111). Based on this detection, as shown in FIG. 7, the first platen roller 13 moves for closing (action A112), and the thermal paper 1 is pressed to the first thermal head 11. In this state, printing is executed by the first thermal head 11 (action A113).

When the printing by the first and second thermal heads 11 and 12 is completed (YES in action A114), the thermal paper 1 is cut by the cutter 5 when the end of the print position of the thermal paper 1 passes through the position of the cutter 5 (action A115). Whether the end of the print position of the thermal paper 1 has passed through the position of the cutter 5 is detected based on a time measurement after the front end of the thermal paper 1 is detected by the paper sensor 6 and an amount of print information.

After the cutting by the cutter 5, the thermal paper 1 is returned toward the home position in the opposite direction of the feeding direction (action A116). At this time, when the front end of the thermal paper 1 passes through the position of the first thermal head and is detected by the paper sensor 6, the first platen roller 13 moves for opening and, when the front end of the thermal paper 1 passes through the position of the second thermal head 12 and is detected by the paper sensor 7, the second platen roller 14 moves for opening (S117).

In addition, in the case of only printing on the front surface by the first thermal head 11 (NO in action A104, and YES in action A118), it is determined whether both the first and second platen rollers 13 and 14 have moved for opening (action A119). If the first and second platen rollers 13 and 14 have not moved for opening (NO in action A119), they are moved for opening (action A120). In this state, feeding of the thermal paper 1 is initiated (action A121). When the front end of the fed thermal paper 1 reaches a position in an upstream direction of the second thermal head 12, the front end of the thermal paper 1 is detected by the paper sensor 7 (YES in action A122). Based on this detection, as shown in FIG. 6, the second platen roller 14 moves for closing (action A123), and the thermal paper 1, being pressed to the second thermal head 12, is fed. Thereafter, the processing of actions 111 to 117 is executed.

In the case of only printing on the rear surface by the second thermal head 12 (NO in action A104, NO in action A118, and YES in action A124), it is determined whether both the first and second platen rollers 13 and 14 have been moved for opening (action A125). If the first and second platen rollers 13 and 14 have not been moved for opening (NO in action A125), they are moved for opening (action A126). In this state, feeding of the thermal paper 1 is initiated (action A127). When the front end of the fed thermal paper 1 reaches a position in an upstream direction of the second thermal head 12, the front end of the thermal paper 1 is detected by the paper sensor 7 (YES in action A128). Based on this detection, as shown in FIG. 6, the second platen roller 14 moves for closing (action A129) and the thermal paper 1 is pressed to the second thermal head 12. In this state, printing is executed by the second thermal head 12 (action A130).

When the front end of the thermal paper 1, which has passed through the position of the second thermal head 12, reaches a position in an upstream direction of the first thermal head 11, the front end of the thermal paper 1 is detected by the paper sensor 6 (YES in action A131). Based on this detection, as shown in FIG. 7, the first platen roller 13 moves for closing (action A132), and the thermal paper 1, being pressed to the first thermal head 11, is fed. Thereafter, the processing of actions 114 to 117 is executed.

As described above, only when the thermal paper 1 passes between the second thermal head 12 and the second platen roller 14 does the second platen roller 14 move for closing, and in other cases, the second platen roller 14 moves for opening; and only when the thermal paper 1 passes between the first thermal head 11 and the first platen roller 13 does the first platen roller 13 move for closing, and in other cases, the first platen roller 13 moves for opening, whereby the pressure applied to the first and second thermal heads 11 and 12 can be reduced to be as small as possible while transferring between feeding and returning the thermal paper 1 appropriately. Accordingly, the life spans of the first and second thermal heads 11 and 12 can be extended.

When the thermal paper 1 is a type containing an IC chip 60, the positions of the closing movement of the first and second platen rollers 13 and 14 are set to be away from the first and second thermal heads 11 and 12, respectively, compared with a general case, whereby the IC chip 60 within the thermal paper 1 is not unnecessarily damaged or interfered with.

Figure 8:
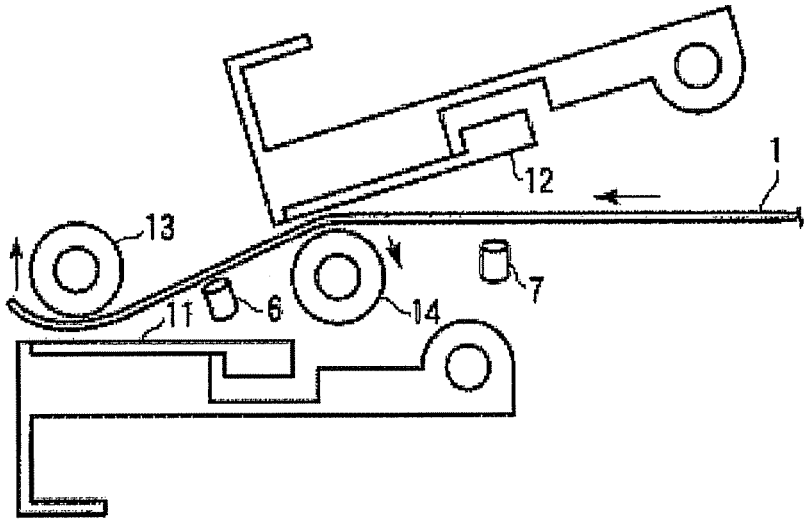
FIG. 8 is a view showing a configuration in which each platen roller has moved to an open position in the embodiment.

When the thermal paper 1 is jammed on the feeding path 4, or in the case of repair or maintenance work, a menu button and a pause button of the manipulation portion 37*a* of the control panel 37 may be pushed at the same time. In this case, as shown in FIG. 8, both the first and second platen rollers 13 and 14 move for opening and are maintained in the opening movement position. According to this opening movement, the thermal paper 1 can be easily removed from the feeding path 4, and thus, the work of the user or service person can be considerably reduced.

Further, if a type of thermal paper 1 in which a plurality of labels are adhered on a band-shaped backing sheet is used, when the thermal paper 1 is transferred in a reverse direction of the feeding direction after being cut and returned to the home position, an end portion of each of the labels may come off upon being brought into contact with the first and second thermal heads 11 and 12. Thus, in a case where the label-adhered type thermal paper 1 is used, the first and second platen rollers 13 and 14 move for opening at a timing when the boundary position of the backing sheet and the label passes the first and second platen rollers 13 and 14, thereby preventing the label from coming off.

As used in this application, objects for executing the actions can refer to a computer-related object, hardware, a combination of hardware and software, software, or software in execution. For example, an object for executing an action can be, but is not limited to, a process running on a processor, a processor, an object, an executable, a thread of execution, a program, and a computer. By way of illustration, both an application running on an apparatus and the apparatus can be the object. One or more objects can reside within a process and/or thread of execution and an object can be localized on one apparatus and/or distributed between two or more apparatuses.

A program for realizing the functions can be recorded in an apparatus, can be downloaded through a network to an apparatus, or can be installed in an apparatus from a computer readable storage medium storing the program therein. The form of a computer readable storage medium can be any form as long as the computer readable storage medium can store programs and is readable by an apparatus such as a disk type ROM and a solid-state computer storage media. The functions obtained by installation or download in advance in this manner can be realized in cooperation with an OS (Operating System) in an apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A thermal printer for printing information on thermal paper having a thermosensitive layer formed on both sides thereof, while feeding the thermal paper, comprising:

first and second thermal heads installed at positions spaced apart from each other along a feeding direction of the thermal paper, the first thermal head printing on one side of the thermal paper and the second thermal head printing on the other side of the thermal paper;

a first platen installed at a position opposite the first thermal head with a feeding path of the thermal paper interposed therebetween, and configured to move for closing so as to approach the first thermal head and move for opening so as to be distanced from the first thermal head, the thermal paper being interposed between the first platen and the first thermal head according to the closing movement of the first platen;

a second platen installed at a position opposite the second thermal head with the feeding path of the thermal paper interposed therebetween, and configured to move for closing so as to approach the second thermal head and move for opening so as to be distanced from the second thermal head, the thermal paper being interposed between the second platen and the second thermal head according to the closing movement of the second platen; and a control unit configured to initiate feeding of the thermal paper in a state in which the first and second platens have moved for opening, execute printing in a state in which the first and second platens have moved for closing when a front end of the thermal paper reaches the first and second thermal heads, respectively, and control the first and second platens to move for opening when the front end of the thermal paper passes through the first and second thermal heads, respectively, while returning the thermal paper, which has been cut after being printed, in an opposite direction of the feeding direction after the cutting operation.

2. The thermal printer of claim 1, further comprising:

a cutter installed at a position in a downstream direction with respect to the thermal heads in the feeding direction of the thermal paper, and configured to cut the printing-completed thermal paper.

3. The thermal printer of claim 2, wherein the control unit is configured to initiate feeding of the thermal paper in a state in which the first and second platens have moved for opening; execute printing in a state in which the first and second platens have moved for closing when a front end of the thermal paper reaches the first and second thermal heads, respectively; drive the cutter to cut the thermal paper when an end of a printing-completed portion of the thermal paper passes through the position of the cutter; and control the first and second platens to move for opening when the front end of the thermal paper passes through the first and second thermal heads, respectively, while returning the thermal paper in the opposite direction of the feeding direction after the cutting operation.

4. The thermal printer of claim 1, wherein the first and second platens have, as closing movement positions, a first closing movement position at which a distance between the respective first and second thermal heads is Dx and a second closing movement position at which the distance between the respective first and second thermal heads is Dy (>Dx), and the control unit is further configured to set the positions of the first and second platens to the first closing movement position when the thermal paper does not include an IC chip and set the positions of the first and second platens to the second closing position when the thermal paper includes an IC chip.

5. The thermal printer of claim 1, wherein the control unit is further configured to control the first and second platens to move for opening according to a certain manipulation, and to be maintained in an opening movement position.

6. A method for driving a thermal printer for printing information on thermal paper having a thermosensitive layer formed on both sides thereof, the thermal printer comprising:

first and second thermal heads installed at positions spaced apart from each other along a feeding direction of the thermal paper, the first thermal head printing on one side of the thermal paper and the second thermal head printing on the other side of the thermal paper;

a first platen installed at a position opposite the first thermal head with a feeding path of the thermal paper interposed therebetween, and configured to move for closing so as to approach the first thermal head and move for opening so as to be distanced from the first thermal head, the thermal paper being interposed between the first platen and the first thermal head according to the closing movement of the first platen; and a second platen installed at a position opposite the second thermal head with the feeding path of the thermal paper interposed therebetween, and configured to move for closing so as to approach the second thermal head and move for opening so as to be distanced from the second thermal head, the thermal paper being interposed between the second platen and the second thermal head according to the closing movement of the second platen, the method comprising:

initiating feeding of the thermal paper in a state in which the first and second platens have moved for opening;

executing printing in a state in which the first and second platens have moved for closing when a front end of the thermal paper reaches the first and second thermal heads, respectively; and controlling the first and second platens to move for opening when the front end of the thermal paper passes through the first and second thermal heads, respectively, while returning the thermal paper, which has been cut after being printed, in an opposite direction of the feeding direction after the cutting operation.

7. The method of claim 6, further comprising:

cutting the printing-completed thermal paper using a cutter installed at a position in a downstream direction with respect to the thermal heads in the feeding direction of the thermal paper.

8. The method of claim 7, further comprising:

initiating feeding of the thermal paper in a state in which the first and second platens have moved for opening;

executing printing in a state in which the first and second platens have moved for closing when a front end of the thermal paper reaches the first and second thermal heads, respectively;

by the cutter, cutting the thermal paper when an end of a printing-completed portion of the thermal paper passes through the position of the cutter; and controlling the first and second platens to move for opening when the front end of the thermal paper passes through the first and second thermal heads, respectively, while returning the thermal paper in the opposite direction of the feeding direction after the cutting operation.

9. The method of claim 6, wherein the first and second platens have, as closing movement positions, a first closing movement position at which a distance between the respective first and second thermal heads is Dx and a second closing movement position at which the distance between the respective first and second thermal heads is Dy (>Dx), and the method further comprising:

controlling the positions of the first and second platens to be set to the first closing movement position when the thermal paper does not include an IC chip and to be set to the second closing position when the thermal paper includes an IC chip.

10. The method of claim 6, further comprising:

controlling the first and second platens to move for opening according to a certain manipulation, and to be maintained in an opening movement position.

* * * * *